US006955152B2

(12) United States Patent
Uhl et al.

(10) Patent No.: US 6,955,152 B2
(45) Date of Patent: Oct. 18, 2005

(54) MANUALLY OPERATED TOOL

(75) Inventors: Klaus-Martin Uhl, Baltmannsweiler (DE); Sebastian Friedrich, Waiblingen (DE)

(73) Assignee: Andreas Stihl AG & Co KG (DE)

( * ) Notice: Subject to any disclaimer, the term of this patent is extended or adjusted under 35 U.S.C. 154(b) by 0 days.

(21) Appl. No.: 10/850,274

(22) Filed: May 20, 2004

(65) Prior Publication Data

US 2004/0231633 A1 Nov. 25, 2004

(30) Foreign Application Priority Data

May 20, 2003 (DE) ..... 103 22 641

(51) Int. Cl.[7] ..... F02B 77/00
(52) U.S. Cl. ..... 123/198 E; 220/905
(58) Field of Search ..... 123/198 E, 184.21, 123/516, 517, 518; 220/4.14, 905

(56) References Cited

U.S. PATENT DOCUMENTS 3,372,679 A 3/1968 Aitken
5,676,115 A * 10/1997 Linsbauer et al. ..... 123/516

* cited by examiner

*Primary Examiner*—Noah P. Kamen
*Assistant Examiner*—Katrina Harris
(74) *Attorney, Agent, or Firm*—Robert W Becker & Associates; Robert W Becker

(57) ABSTRACT

A manually operated tool such as a parting-off grinder, chainsaw or similar device has a tank housing which contains a fuel tank. The tool has an air cleaning unit, the tank housing being connected to the clean air side of the air cleaning unit via a bleed device. A simple design in which leaks are avoided results if a reservoir wall of the tank housing and a housing wall of the air cleaning unit are positioned adjacent to one another and the bleed device comprises a bleed opening which passes through the reservoir wall and the housing wall.

21 Claims, 3 Drawing Sheets

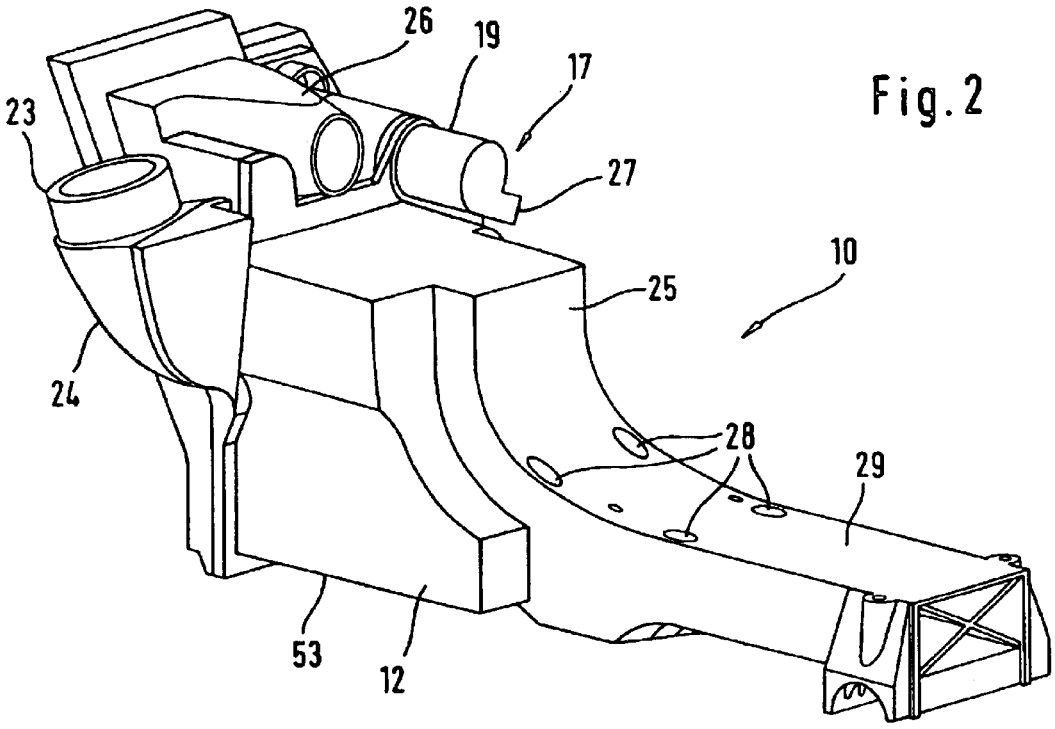
Fig. 2
Fig. 3
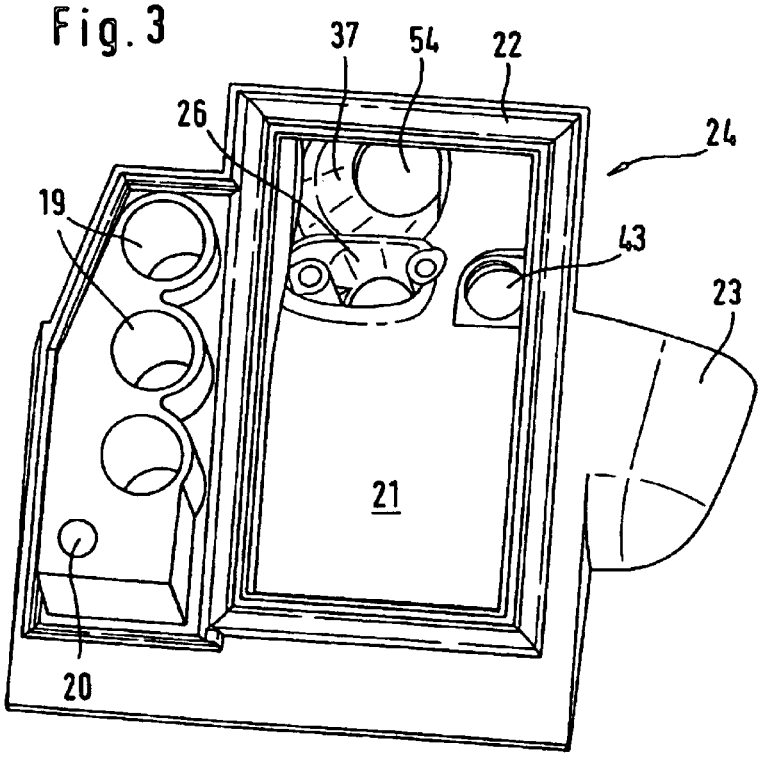
Fig. 4
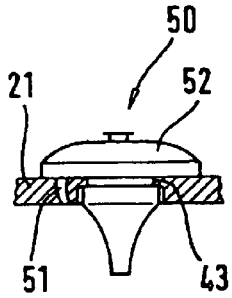

MANUALLY OPERATED TOOL

BACKGROUND OF THE INVENTION

The invention relates to a manually operated tool such as a parting-off grinder, chain saw or similar device.

A chain saw which has a fuel tank with an equalizing reservoir is known from U.S. Pat. No. 3,372,679. The equalizing reservoir is connected to the carburetor housing from which the cleaned air is aspirated via a line. The line runs outside the tank housing and the carburetor housing. Leaks leading to the escape of fuel may occur at the connections and the line itself. Costly seals are required in order to avoid this. Assembly is costly since it is necessary to ensure that all connection points are leakproof.

The object of the invention is to create a tool of the aforementioned general type in which fuel leaks are avoided.

This object is achieved by means of a tool or implement comprising an air cleaning unit and a tank housing, wherein a reservoir wall of the tank housing and a housing wall of the air cleaning unit are disposed adjacent to one another, and wherein the tank housing is in communication with the clean air side of the air cleaning unit via a bleed device that includes a bleed opening which extends through the reservoir wall and the housing wall.

The invention provides for a design in which the tank housing and the air cleaning unit are positioned directly adjacent to one another. Bleeding or venting can be effected via an opening in the adjacent walls without the need for costly seals.

A bleed valve is advantageously positioned in the bleed opening. In this arrangement the bleed valve is particularly a mushroom valve. Leaks between the air cleaning unit and the tank housing can be completely avoided if the reservoir wall of the tank housing is formed onto the housing wall of the air-cleaning unit. In this arrangement the reservoir wall and the housing wall are preferably formed as one piece and thus form a common dividing wall. This means that there is no connection between the bleed opening and the environment and the need for costly seals is thereby obviated. The bleed device can be manufactured together with the tank housing in one work cycle. Additional assembly cycles are then needed only to clip the valve into place. However, this entails no special sealing measures since leaks cannot lead to the escape of fuel. This significantly simplifies the manufacture of the tool.

In the invention, the air cleaning unit comprises an air filter unit. The housing wall is in particular the air filter base. This results in a simpler, more compact design of tank housing. The integral forming of the air filter base also reduces the number of components required.

The tank housing is particularly made of two molded shells with a parting plane which runs at right angles to the longitudinal axis of the tool. This means, particularly where an injection moulding process is used for manufacture, that both molded shells can be removed from their moulds without cores being required for manufacture. A simple manufacturing process is achieved if both molded shells are joined together by means of welding, where plastic is used in particular by means of ultrasound welding. Advantageously the tank housing contains a fuel tank and an equalizing reservoir and the bleed opening is positioned in the reservoir wall of the equalizing reservoir. The equalizing reservoir is expediently connected to the fuel tank via an equalizing line which runs in the parting plane of the two molded shells. In this arrangement the equalizing line is in particular integrated into the two molded shells. This means that no further individual parts or connections are required. The equalizing line can be welded in the working cycle in which the two molded shells are joined together. The equalizing reservoir is advantageously connected to the bleed opening via a bleed line. This permits optimum arrangement of the equalizing reservoir and the bleed opening. At the same time the line reduces the risk of fuel escaping through the bleed opening. The bleed line is also expediently integrated into the molded shells so that it can be manufactured and welded in the same working cycle as they are.

In order to achieve good air cleaning, the air cleaning unit comprises a cyclone unit with at least one cyclone tube. The cyclone tube is advantageously formed at least partially in one piece with the tank housing. This ensures a simple manufacturing process and a compact design of the tank housing. Advantageously at least one cyclone tube lies along the longitudinal axis of the tool and passes at least partially through the tank housing. This orientation along the longitudinal axis of the tool means that the molded shells of the tank housing can be removed easily from their moulds. The arrangement of the cyclone tubes in the area of the tank housing such that the cyclone tubes pass through the tank housing results in a compact tool design. The tank housing is expediently a load-bearing housing part of the tool. The tank housing is advantageously made of plastic. This results in a low tool weight while guaranteeing adequate rigidity and good vibration characteristics. At the same time it also permits cost-effective manufacture.

Embodiments of the invention are explained below with reference to the drawings, in which:

FIG. 2 shows a perspective view of a tank housing;

FIG. 3 shows a perspective view of one molded shell of the tank housing;

FIG. 4 shows a section of the bleed valve; and

Figure 5:
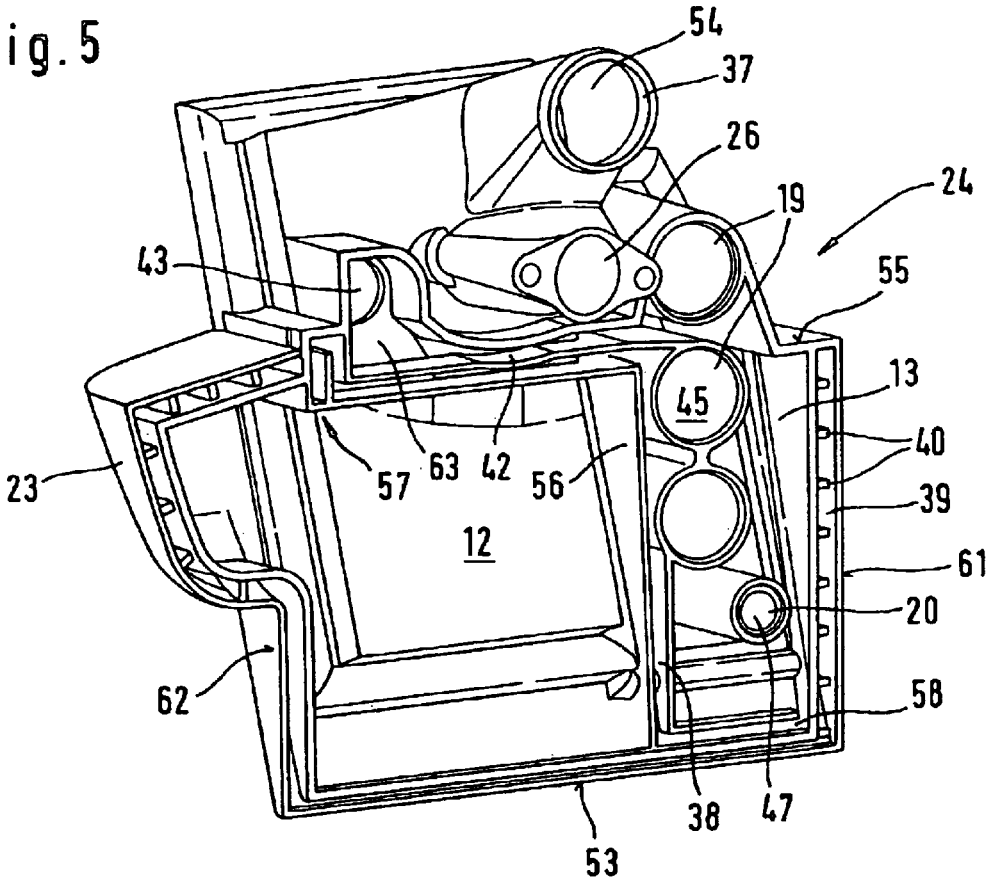

FIGS. 5/6 show perspective views of the molded shells of the tank housing.

Figure 1:
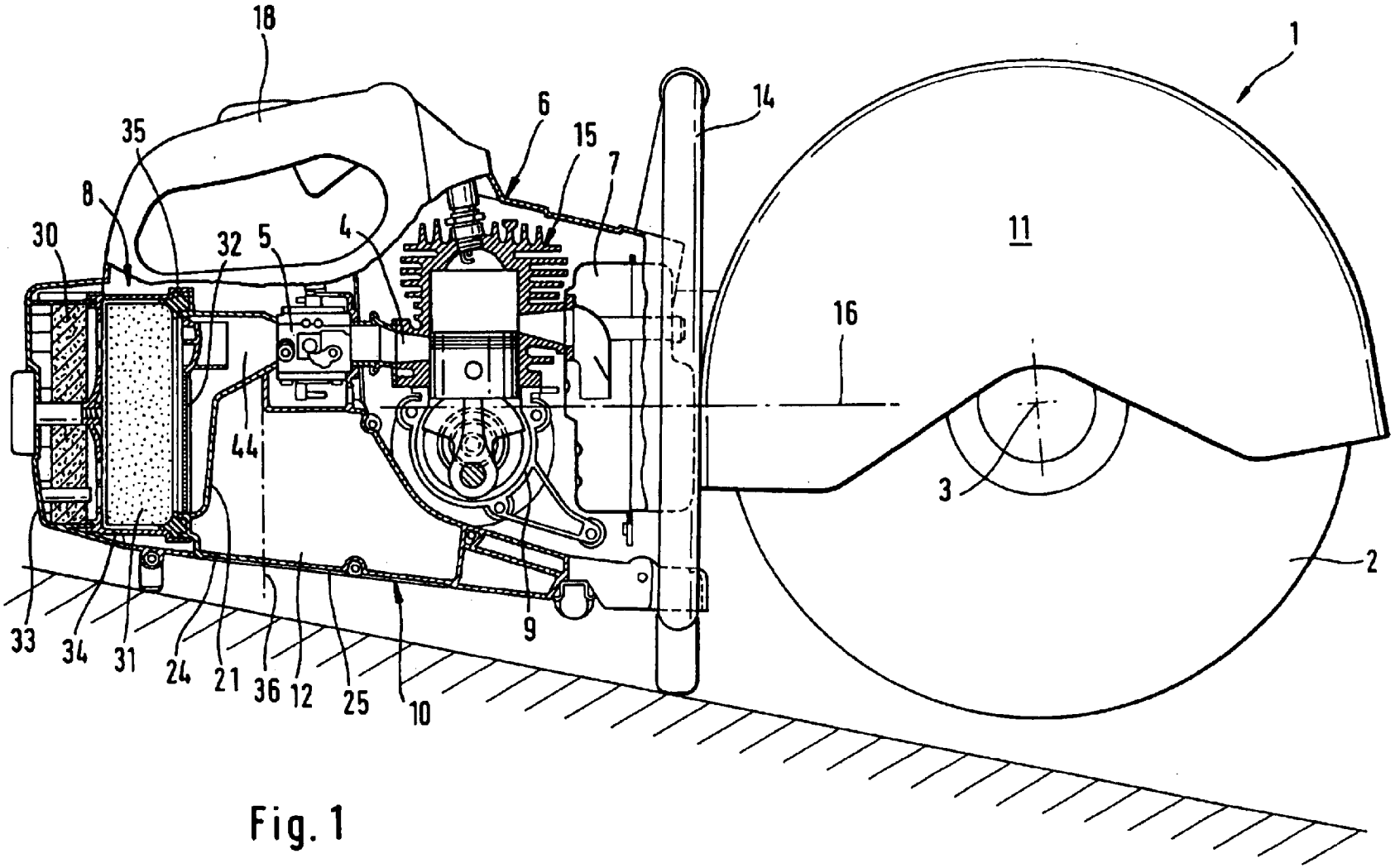
FIG. 1 shows a side view of a partial section of a parting-off grinder.

FIG. 1 shows a cut-off machine or parting-off grinder 1 with a parting-off wheel 2 which is driven so that it rotates about an axis 3. The parting-off wheel 2 is partially surrounded by a protective hood 11. The parting-off grinder 1 has a housing 6 in which is positioned a two-stroke engine 15 which drives the parting-off wheel 2 via a belt drive (not illustrated). An exhaust muffler 7 is positioned at the outlet from the two-stroke engine 15. Fuel/air mixture prepared in a carburetor 5 is fed to the two-stroke engine 15 via the intake duct 4. The carburetor 5 is connected to the clean air side 44 of an air cleaning unit. The air cleaning unit comprises an air filter unit 8 with a pre-filter 30 which is positioned in a cover 33, a main filter 31 in an air filter housing (34) and a fine filter 32. The air filter housing is sealed from the air filter base 21.

The parting-off grinder 1 has a tank housing 10 which is formed onto the air filter base 21. The tank housing 10 is formed of two molded or partial shells (24 and 25) which are connected to one another at a parting plane 36. The tank housing 10 contains a fuel tank 12. The two-stroke engine has a crankcase 9 which lies on and is screwed to the tank housing 10. An upper handle 18 which runs approximately along the longitudinal axis 16 of the parting-off grinder and a grip tube 14 which extends in a plane approximately perpendicular to the longitudinal axis 16 are provided to operate the parting-off grinder 1. The longitudinal axis 16 of the parting-off grinder 1 runs approximately in the direction of the intake duct 4 and characterises the longest part of the parting-off grinder 1. In this arrangement the longitudinal axis 16 lies in the plane formed by the parting-off wheel 2.

FIG. 2 shows a perspective view of the tank housing 10. Formed onto the first molded shell 24 facing away from the parting-off wheel 2 is a tank connector 23 which opens into the fuel tank 12 and serves to fill the fuel tank. Formed onto the first molded shell 24 is a connector 26 which connects the clean air side 44 of the air filter unit 8 to the carburetor 5. In addition to the air filter unit 8, the air cleaning unit also contains a cyclone unit 17 which comprises several cyclone tubes 19. The cyclone tubes 19 are aligned approximately along the longitudinal axis 16 of the parting-off grinder 1 and are formed onto the molded shells (24 and 25). Provided at the end of the cyclone tubes 19 facing the parting-off wheel 2 is a tangentially running inlet 27 into the cyclone tubes 19. In the area of the base 53 of the tank housing 10, the second molded shell 25 has a straight section 29 which extends towards the parting-off wheel 2. Located in the straight section 29 are four holes 28 via which the two-stroke engine 15 can be screwed to the tank housing 10. The two-stroke engine is thus screwed to the straight section 29 from the base 53.

FIG. 3 shows the first molded shell 24 of a tank housing 10. Components which are identical to those illustrated in FIGS. 1 and 2 are designated by the same reference numerals. Formed onto the air filter base 21 is a peripheral sealing edge 22 in which the seal 35 shown in FIG. 1 is held. The seal 35 seals the air filter housing (34) against the air filter base 21. Also provided in the molded shell 24 shown in FIG. 3, in addition to the connector 26 leading to the intake duct 4, is a connector 37 which carries an air duct 54. Formed onto the first molded shell 24 are cyclone tubes 19 and a return 20. The return 20 serves to carry the dirt separated in the cyclone tubes 19 away to the fan wheel of the parting-off grinder 1. Provided in the air filter base 21 is a bleed opening 43 via which the tank housing 10 is connected to the clean air side 44 of the air filter unit 8. The bleed valve 50 illustrated in FIG. 4 which is designed as a mushroom valve can be connected to the bleed opening 43. The valve 50 has a valve member 52 which lies on the air filter base 21. As the pressure increases, the valve member 52 lifts off the air filter base 21 and air is able to flow through the duct 51 onto the clean air side 44 of the air filter unit 8. Instead of the valve 50, it is also possible to use another valve, for example an aeration valve, or a complete assembly.

Figure 6:
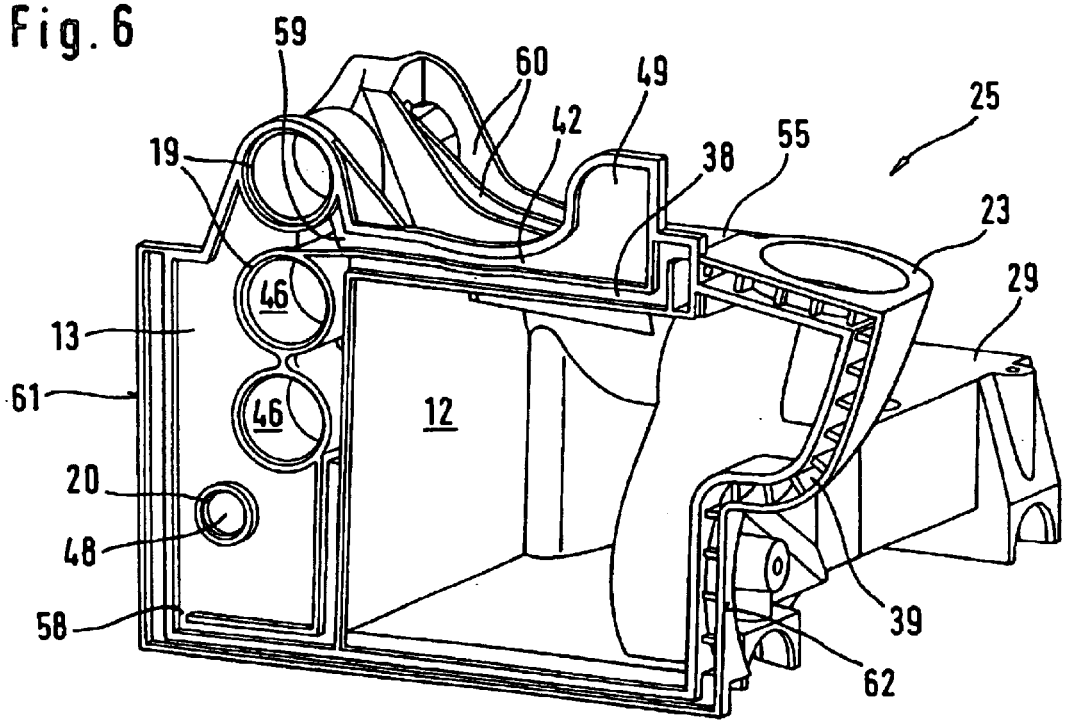

FIG. 5 shows the first molded shell 24 from the side facing the second molded shell 25. The tank housing 10 contains an equalizing reservoir 13. The bleed opening 43 is positioned in a reservoir wall 63 of the equalizing reservoir 13. The bleed opening 43 is connected to the equalizing reservoir 13 via a bleed line 42. The bleed line 42 runs along the roof 55 of the tank housing 10 in the parting plane 36 of the two molded shells (24, 25) and is formed onto the two molded shells (24, 25). The cyclone tubes 19 and the return 20 pass through the equalizing reservoir 13. In this arrangement a section 45 of the cylinder tubes 19 is formed onto the first molded shell 24 and a further section 46, illustrated in FIG. 6, is formed onto the second molded shell 25. Similarly, a section 47 of the return 20 is formed onto the first molded shell 24 and a section 48 is formed onto the second molded shell 25.

The equalizing reservoir 13 is connected to the fuel tank 12 via an equalizing line 38. The equalizing line 38 has a connection to the fuel tank 12 in an area 57 so that air is preferably able to flow into the equalizing line 38 for pressure equalisation. The area 57 is positioned in the area of the roof 55 of the tank housing 10. The equalizing line 38 passes through the area 57 in the manner of a labyrinth. The equalizing line 38 then runs through the area of the roof 55 of the tank housing 10 and along a lateral wall 56 of the fuel tank 12. In the area of the lateral wall 56 the equalizing line 38 passes between the cyclone tubes 19 and the lateral wall 56. The equalizing line 38 then extends through the area of the base 53 of the tank housing 10 to an outlet 58 in the equalizing reservoir 13.

The wall 39 of the tank housing 10 is designed with double walls and has reinforcing struts 40. In this arrangement the double wall 39 runs along the longitudinal sides (61 and 62) of the tank housing 10 and along the base 53.

As shown in FIG. 6, the bleed line 42 has an inlet 59 at which it opens into the equalizing reservoir 13 in the area of the roof 55. At the other end of the bleed line 42 a cover section 49 is formed onto the second molded shell 25 which seals the bleed line 42 in the area of the bleed opening 43. Reinforcing struts 60 are formed onto the second molded shell 25 in the area of the roof 55.

The bleed line 42 and the equalizing line 38 are formed onto the two molded shells (24 and 25) and pass through the inside of the tank housing 10. Similarly, the bleed opening 43 forms an opening in an inner wall, i.e. the air filter base 21. This avoids leaks on the outside of the tank. The tank housing 10 is advantageously made of plastic. The two molded shells (24 and 25) are expediently joined together by means of welding, fusing or heat sealing, in particular hot gas welding.

In the event of overpressure in the fuel tank 12 air is able to flow into the equalizing reservoir 13 during operation via the equalizing line 38. To further reduce pressure air is also able to flow to the clean air side 44 of the air filter unit 8 via the bleed line 42 and the bleed opening 43. Fuel carried with it is either aspirated into the carburetor 5 from the clean air side 44 or collects at the base of the equalizing reservoir 13 from where it flows back to the fuel tank 12 via the equalizing line 38. It may be useful for the fuel tank to be connected directly to the clean air side 44 of the air cleaning unit via a bleed opening and no equalizing reservoir 13 to be provided.

The specification incorporates by reference the disclosure of German priority document 103 22 641.9 filed 20 May 2003.

The present invention is, of course, in no way restricted to the specific disclosure of the specification and drawings, but also encompasses any modifications within the scope of the appended claims.

We claim:

1. A manually operated implement comprising:

an air cleaning unit; and a tank housing, wherein a fuel tank is formed in the tank housing, wherein a reservoir wall of said tank housing and a housing wall of said air cleaning unit are disposed adjacent to one another, wherein said tank housing is in communication with a clean air side of said air cleaning unit via a bleed device, wherein the bleed device includes a bleed opening, wherein the bleed opening is disposed in said housing wall of said air cleaning unit, wherein the bleed opening is a continuous bleed opening that runs through the reservoir wall of the tank housing and the housing wall of the air cleaning unit.

2. An implement according to claim 1, wherein a bleed valve is disposed in said bleed opening.

3. An implement according to claim 2, wherein said bleed valve is a mushroom valve.

4. An implement according to claim 1, wherein said reservoir wall of said tank housing is formed on said housing wall of said air cleaning unit.

5. An implement according to claim 4, wherein said reservoir wall is monolithically formed with said housing wall of said air cleaning unit.

6. An implement according to claim 1, wherein said air cleaning unit is an air filter unit.

7. An implement according to claim 6, wherein said housing wall is an air filter base.

8. An implement according to claim 1, wherein said tank housing is formed of two partial shells, a plane of separation of which extends transverse to a longitudinal direction of said implement.

9. An implement according to claim 8, wherein said two partial shells are interconnected by fusing.

10. An implement according to claim 8, wherein an equalizing reservoir are is formed in said tank housing, wherein said reservoir wall is a reservoir wall of said equalizing reservoir, and wherein said bleed opening is disposed in said reservoir wall.

11. An implement according to claim 10, wherein said equalizing reservoir is in communication with said fuel tank via an equalizing line that is disposed in said plane of separation of said two partial shells.

12. An implement according to claim 11, wherein said equalizing line is integrated into said two partial shells.

13. An implement according to claim 10, wherein said equalizing reservoir is connected with said bleed opening via a bleed line.

14. An implement according to claim 13, wherein said bleed line is integrated into said two partial shells.

15. An implement according to claim 1, wherein said air cleaning unit includes a cyclone unit that is at least partially monolithically formed with said tank housing.

16. An implement according to claim 15, wherein at least one cyclone tube of said cyclone unit is disposed in a longitudinal direction of said implement and at least partially extends through said tank housing.

17. An implement according to claim 1, wherein said tank housing is a load-bearing housing component of said implement.

18. An implement according to claim 1, wherein said tank housing is made of plastic.

19. A manually operated implement comprising:

an air cleaning unit; and a tank housing, wherein a reservoir wall of said tank housing and a housing wall of said air cleaning unit are disposed adjacent to one another, and wherein said tank housing is in communication with a clean air side of said air cleaning unit via a bleed device that includes a bleed opening which extends through said reservoir wall and said housing wall, wherein said reservoir wall of said tank housing is formed on said housing wall of said air cleaning unit.

20. A manually operated implement comprising:

an air cleaning unit; and a tank housing, wherein a reservoir wall of said tank housing and a housing wall of said air cleaning unit are disposed adjacent to one another, and wherein said tank housing is in communication with a clean air side of said air cleaning unit via a bleed device that includes a bleed opening which extends through said reservoir wall and said housing wall, wherein said tank housing is formed of two partial shells, a plane of separation of which extends transverse to a longitudinal direction of said implement.

21. A manually operated implement comprising:

an air cleaning unit; and a tank housing, wherein a reservoir wall of said tank housing and a housing wall of said air cleaning unit are disposed adjacent to one another, and wherein said tank housing is in communication with a clean air side of said air cleaning unit via a bleed device that includes a bleed opening which extends through said reservoir wall and said housing wall, wherein said air cleaning unit includes a cyclone unit that is at least partially monolithically formed with said tank housing.

* * * * *